US008009805B2

(12) United States Patent
Smith et al.

(10) Patent No.: US 8,009,805 B2
(45) Date of Patent: Aug. 30, 2011

(54) ROTATING UNION FOR A LIQUID COOLED ROTATING X-RAY TARGET

(75) Inventors: Walter John Smith, Ballston Spa, NY (US); Vance Scott Robinson, Niskayuna, NY (US); Aniruddha Dattatraya Gadre, Rexford, NY (US); Mark Alan Frontera, Ballston Lake, NY (US)

(73) Assignee: General Electric Company, Niskayuna, NY (US)

( * ) Notice: Subject to any disclaimer, the term of this patent is extended or adjusted under 35 U.S.C. 154(b) by 225 days.

(21) Appl. No.: 12/480,808

(22) Filed: Jun. 9, 2009

(65) Prior Publication Data

US 2010/0310050 A1 Dec. 9, 2010

(51) Int. Cl.
*H01J 35/10* (2006.01)

(52) U.S. Cl. ..... 378/130; 378/200

(58) Field of Classification Search ..... 378/119, 378/127, 130, 132, 141, 199, 200
See application file for complete search history.

(56) References Cited

U.S. PATENT DOCUMENTS

| | | | | |
|---|---|---|---|---|
| 4,130,773 | A * | 12/1978 | Kussel | 378/123 |
| 5,018,181 | A | 5/1991 | Iversen et al. | |
| 5,077,781 | A | 12/1991 | Iversen | |
| 5,617,879 | A | 4/1997 | Kubala | |
| 6,252,934 | B1 | 6/2001 | Scott et al. | |
| 7,197,117 | B2 * | 3/2007 | Sakata et al. | 378/130 |
| 2006/0082143 | A1 | 4/2006 | Pospisil et al. | |
| 2008/0016950 | A1 | 1/2008 | Kubala | |

FOREIGN PATENT DOCUMENTS

EP 0665574 A1 8/1995

* cited by examiner

*Primary Examiner* — Irakli Kiknadze
(74) *Attorney, Agent, or Firm* — Jason K. Klindtworth

(57) ABSTRACT

A rotating union for an X-ray target is provided. The rotating union for the X-ray target comprises a housing, a coolant-slinging device comprising a rotating shaft having an inner diameter and an outer diameter, a proximal end and a distal end, and a bore therein, one or more slingers coupled to a proximal end of the rotating shaft; a drain annulus coupled to the one or more slingers, wherein the one or more slingers are configured to direct a coolant to the drain annulus and the drain annulus is configured to direct the coolant through a primary coolant outlet; and a stationary tube having a first end and a second end, wherein at least a portion of the stationary tube is disposed within the bore of the rotating shaft.

13 Claims, 5 Drawing Sheets

ROTATING UNION FOR A LIQUID COOLED ROTATING X-RAY TARGET

BACKGROUND

Embodiments of the present invention relate generally to a rotating union for transferring fluids from a stationary supply to a rotating component. More particularly, the embodiments of the present invention relate to a rotating union for preventing leakage of fluid between a rotating component and a stationary supply in an X-ray tube based imaging system.

X-ray tube based imaging systems, such as computed tomography (CT) imaging systems as well as non-destructive testing systems, employ X-ray sources located on a gantry. Typically these x-ray tubes are anode based x-ray tubes. These anode X-ray tubes typically require high voltage to generate X-rays. Unfortunately these anode X-ray tubes tend to get heated while generating the X-rays. Currently, X-ray tubes employing a rotating shaft protruding out of a vacuum vessel may use a Ferro-fluidic seal to separate vacuum from the atmosphere. The liquid coolant may be directed through the rotating shaft to cool the X-ray target, the Ferro-fluidic seal and the shaft bearings. This configuration needs supply of coolant from a non-rotating part to the rotating part without leakage.

Furthermore, in CT systems, the gantry is rotated around an object at very high speeds. The high speed rotation of the gantry creates a centrifugal force which may typically be in multiples of the force of gravity thereby creating high gravitational loads (G-loads) on a rotating object. A standard face seal rotating union can fail to prevent leakage caused due to high G-loads. The high G-loads may cause the rotating shaft coupled to the X-ray target to bend thereby causing the rotating face seal to misalign from the non-rotating face seal mate. This may cause uneven wear resulting in leakage of coolant. Additionally, a gap may be formed between the faces of the seals causing leakage of coolant. Also, the liquid coolant for cooling various components of the X-ray tube may leak from the rotating union due to the design of the rotating union especially for rotating unions employing standard face seals. Coolant leakage may also occur due to wear and tear of certain components or due to any malfunctioning of the rotating union. The coolant leakage may be detrimental to the imaging system which includes the rotating union or to the environment in which the imaging system operates. Furthermore, deflection of the shaft at the interface of a mechanical face seal may create pressure gradients that may in turn cause uneven wear, leakage and shorter life of a mechanical face seal.

It is therefore desirable to prevent fluid leakage from a rotating union without employing a mechanical face seal.

BRIEF DESCRIPTION

Briefly in accordance with one aspect of the present technique a coolant-slinging device is provided. The coolant-slinging device comprises a rotating shaft having a proximal end and a distal end; one or more slingers coupled to the proximal end of the rotating shaft, and a drain annulus coupled to the one or more slingers, wherein the one or more slingers are configured to direct a coolant to the drain annulus and the drain annulus is configured to direct the coolant through a primary coolant outlet.

In accordance with another aspect of the present technique a rotating union for an X-ray target is provided. The rotating union for the X-ray target comprises a housing, a coolant-slinging device comprising a rotating shaft having an inner diameter and an outer diameter, a proximal end and a distal end, and a bore therein, one or more slingers coupled to a proximal end of the rotating shaft; a drain annulus coupled to the one or more slingers, wherein the one or more slingers are configured to direct a coolant to the drain annulus and the drain annulus is configured to direct the coolant through a primary coolant outlet; and a stationary tube having a first end and a second end wherein at least a portion of the stationary tube is disposed within the bore of the rotating shaft.

In accordance with yet another aspect of the present technique an X-ray source is provided. The X-ray source comprises a rotating union comprising a housing, a coolant-slinging device comprising a rotating shaft having an inner diameter and an outer diameter, a proximal end and a distal end, and a bore therein, one or more slingers coupled to a proximal end of the rotating shaft, a drain annulus coupled to the one or more slingers, wherein the one or more slingers are configured to direct a coolant to the drain annulus, and wherein the drain annulus is configured to direct the coolant through a primary coolant outlet; a stationary tube having a first end and a second end wherein at least a portion of the stationary tube is disposed within the bore of the rotating shaft. Further, the X-ray source comprises a target operationally coupled to the distal end of the rotating shaft via a rotating hollow shaft.

In accordance with a further aspect of the technique a computed tomography system is provided. The computed tomography system comprises an X-ray source for generating an X-ray beam, wherein the X-ray source comprises an X-ray target, and a rotating union comprising a housing, a coolant-slinging device, comprising a rotating shaft having an inner diameter and an outer diameter, a proximal end and a distal end, and a bore therein, one or more slingers coupled to a proximal end of the rotating shaft, a drain annulus coupled to the one or more slingers, wherein the one or more slingers are configured to direct a coolant to the drain annulus, and wherein the drain annulus is configured to direct the coolant through a primary coolant outlet, a stationary tube having a first end and a second end wherein at least a portion of the stationary tube is disposed within the bore of the rotating shaft. Further, the computed tomography system comprises an array of detector elements for detecting attenuated X-ray beam from an imaging object and a display for displaying an image of the imaging object.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Embodiments of the present invention relate generally to a rotating union for a liquid cooled X-ray target in medical imaging systems and more particularly to a rotating union for an X-ray target in X-ray tubes. An exemplary rotating union in X-ray tube based imaging systems such as a computed tomography system is presented.

Figure 1:
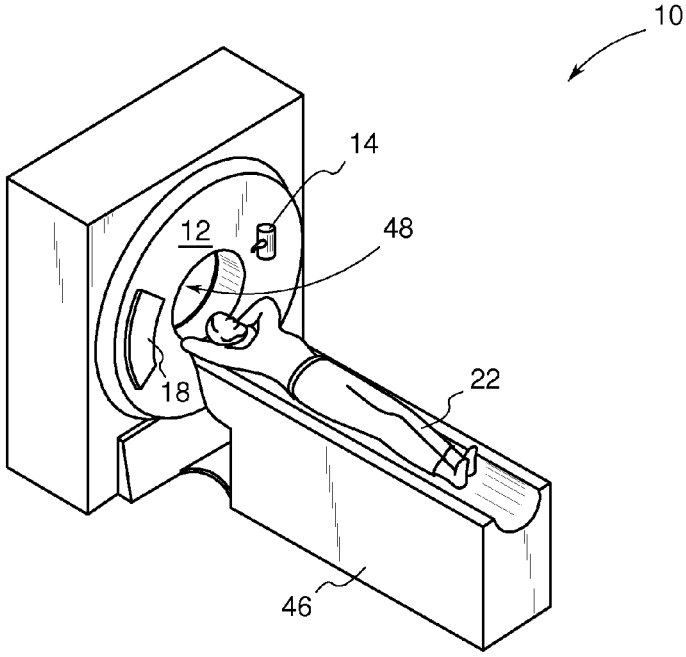
FIG. 1 is a pictorial view of a CT imaging system.
Figure 2:
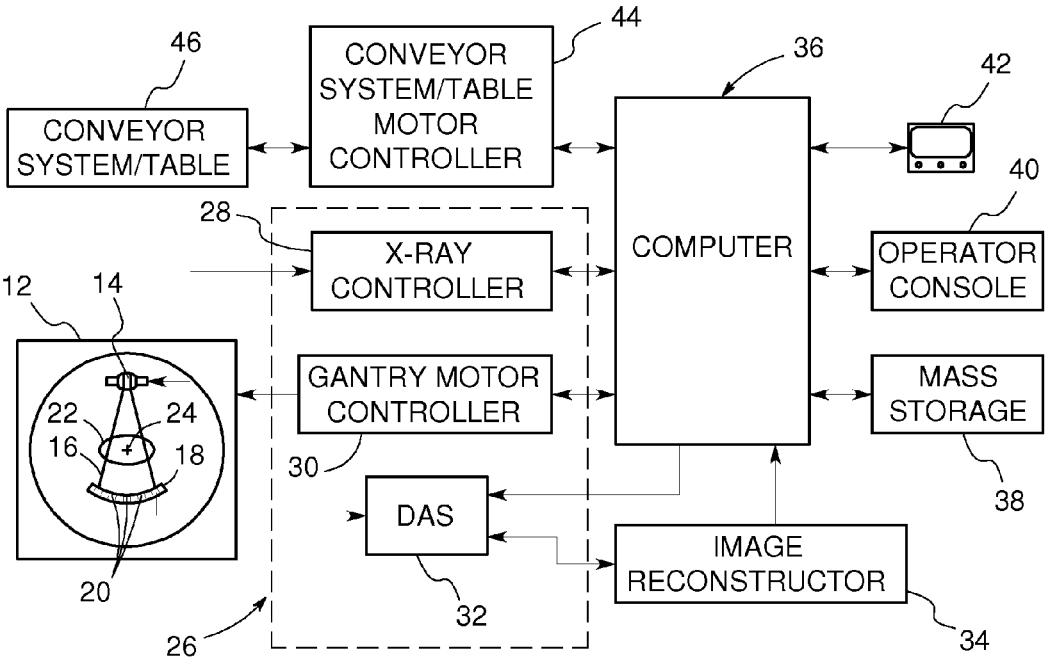
FIG. 2 is a block schematic diagram of the system illustrated in FIG. 1.

Referring now to FIGS. 1 and 2, a computed tomography (CT) imaging system 10 includes a gantry 12 representative of a "third generation" CT scanner. Gantry 12 has an X-ray source 14 that projects a beam of X-rays 16 towards a detector array 18 on the opposite side of gantry 12. In one embodiment, the gantry 12 may have multiple X-ray sources that project beams of X-rays. The detector array 18 is formed by a plurality of detectors 20 which together sense the projected X-rays that pass through an object to be imaged, such as a medical patient 22. During a scan to acquire X-ray projection data, the gantry 12 and the components mounted thereon rotate about a center of rotation 24. While the CT imaging system 10 is shown in reference to the medical patient 22, it should be appreciated that the imaging system 10 may have applications outside the medical realm. For example, the CT imaging system 10 may be utilized in a luggage screening capacity, for ascertaining the contents of closed articles, such as luggage, packages, etc., and in search of contraband such as explosives and/or biohazardous materials.

Rotation of the gantry 12 and the operation of the X-ray source 14 are governed by a control mechanism 26 of the CT system 10. The control mechanism 26 includes an X-ray controller 28 that provides power and timing signals to the X-ray source 14 and a gantry motor controller 30 that controls the rotational speed and position of the gantry 12. A data acquisition system (DAS) 32 in the control mechanism 26 samples analog data from the detectors 20 and converts the data to digital signals for subsequent processing. An image reconstructor 34 receives sampled and digitized X-ray data from the DAS 32 and performs high-speed reconstruction. The reconstructed image is applied as an input to a computer 36, which stores the image in a mass storage device 38.

Moreover, the computer 36 also receives commands and scanning parameters from an operator via console 40 that has an input device such as a keyboard (not shown in FIGS. 1-2). An associated display 42 allows the operator to observe the reconstructed image and other data from the computer 36. The commands and parameters supplied by the operator are used by the computer 36 to provide control and signal information to the DAS 32, the X-ray controller 28 and the gantry motor controller 30. In addition, the computer 36 operates a table motor controller 44, which controls a motorized table 46 to position the patient 22 and the gantry 12. Particularly, the table 46 moves portions of patient 22 through a gantry opening 48. It may be noted that in certain embodiments, the computer 36 may operate a conveyor system controller 44, which controls a conveyor system 46 to position an object, such as, a baggage or luggage and the gantry 12. More particularly, the conveyor system 46 moves the object through the gantry opening 48.

Figure 3:
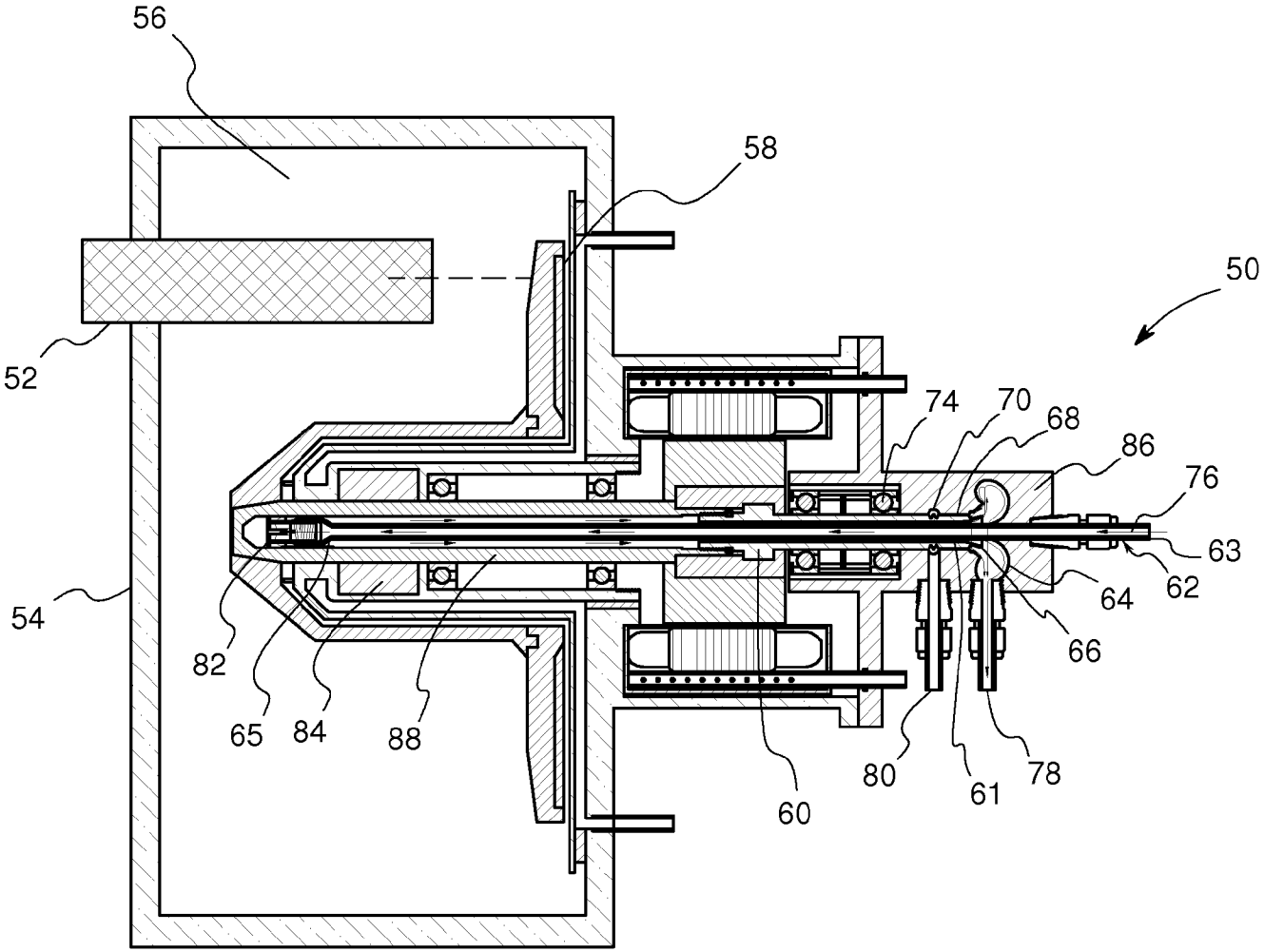
FIG. 3 is a cross-sectional view of an exemplary rotating union coupled to an X-ray target, in accordance with aspects of the present technique.

Referring now to FIG. 3, a rotating union 50 coupled to an X-ray source such as the X-ray source 14 of FIGS. 1-2 is presented. The X-ray source with the rotating union 50 includes an electron emitter 52 which may be an electron emitting cathode enclosed in vacuum vessel 54 having a vacuum 56 therein. The electron emitter 52 emits a beam of electrons when a high voltage is supplied to the electron emitter 52. The electron beam emitted by the electron emitter 52 is accelerated in the vacuum vessel 54 to strike an anode such as a target 58 to produce X-rays. In the present embodiment, the target 58 rotates so that the electron beam striking the target 58 does not cause the metal to melt. It may be noted that the target 58 may include materials such as, but not limited to tungsten, molybdenum or copper.

In accordance with aspects of the present technique, the target 58 may be operationally coupled to the rotating union 50. Therefore, the rotating shaft 60 of the rotating union 50 and the X-ray target 58 rotate together. In accordance with aspects of the present technique, the rotating shaft 60 of the rotating union 50 may be coupled to a rotating hollow shaft 88 of the X-ray target 58. Furthermore, in accordance with aspects of the present technique the rotating union 50 is configured to supply a liquid coolant from a stationary supply (not shown) to the X-ray target 58 and back to the stationary supply.

The liquid coolant may be supplied to the target 58 via a stationary tube 62, which may be passed through a bore of a rotating shaft 60 of the rotating union 50, where the rotating shaft 60 may include an inner diameter and an outer diameter. More particularly, the stationary tube 62 may pass through the inner diameter of the rotating shaft 60. In one embodiment, the rotating union 50 may be disposed in a housing 86 configured to provide support to the rotating union 50 and may also include various components as will be described later. As previously noted, the various components of the X-ray source 14 (see FIGS. 1-2) may be heated upon application of a high voltage to generate an X-ray beam. It is therefore desirable to dissipate heat from the various components in the X-ray source 14 such as, but not limited to the rotating target 58 and a Ferro-fluidic seal 84, through use of a liquid coolant such as, but not limited to water. Further, in accordance with exemplary aspects of the present technique the rotating union 50 may be designed in a manner to prevent leakage of the liquid coolant as will be described hereinafter.

As previously noted, the stationary tube 62 may be employed to direct flow of the liquid coolant from the stationary supply (not shown in FIG. 3) to the rotating X-ray target 58. Also, as described hereinabove, the stationary tube 62 may be disposed in manner such that at least a portion of the stationary tube 62 may be disposed within a bore of the rotating shaft 60 of the rotating union 50. The stationary tube 62 includes a first end 63 and a second end 65. In one embodiment the first end 63 of the stationary tube 62 may protrude from the bore of the rotating shaft 60. In another embodiment, the second end 65 of the stationary tube 62 may protrude from the bore of the rotating shaft 60. Alternatively, the first end 63 and the second end 65 of the stationary tube may protrude from the bore of the rotating shaft 60. The liquid coolant may be supplied through the first end 63 of the stationary tube 62. Reference numeral 76 may be generally representative of a flow of the liquid coolant from the first end 63 of the stationary tube 62 towards the second end 65 of the stationary tube 62. Upon reaching the second end 65 of the stationary tube 62, the liquid coolant may be directed into an annular space between the rotating shaft 60 and the stationary tube 62 via a tube bearing 82. More specifically, the flow 76 of the liquid coolant is reversed when the liquid coolant reaches the second end 65 of the stationary tube 62. Particularly, the liquid coolant may flow into the space between the rotating hollow shaft 88 of the X-ray target 58 and the stationary tube 62. Thereafter, the liquid coolant may pass through an exemplary coolant-slinging device.

As previously noted, the liquid coolant may leak, from the mating surface of a standard face seal causing damage to components of the imaging system and thereby damaging the imaging system. In accordance with aspects of the present technique, the coolant-slinging device may be configured to prevent leakage of the liquid coolant by facilitating collection of any liquid coolant that may have leaked and directing the leaked liquid coolant out of the rotating union 50 and back to the stationary supply.

In accordance with exemplary aspects of the present technique, the coolant-slinging device may also include one or more slingers 66. Additionally, the coolant-slinging device may include a drain annulus surrounding the one or more slingers 66. The one or more slingers 66 may have a first end and a second end wherein the first end of the one or more slingers 66 may be smaller in diameter than the second end. In one embodiment, the one or more slingers 66 may be disposed on a first or proximal end 61 of the rotating shaft 60. Furthermore, the one or more slingers 66 may be configured to direct the liquid coolant to a drain annulus 64 and the drain annulus 64 is configured to direct the liquid coolant through a primary coolant outlet 78.

In one embodiment, the proximal end 61 of the rotating shaft 60 may be machined to form the one or more slingers 66. In an alternate embodiment, the one or more slingers 66 may be coupled to or bonded via a bonding material to the proximal end 61 of the rotating shaft 60. In one embodiment the one or more slingers may be attached to the proximal end 61 of the rotating shaft 60 by a technique which is generally known as "shrink fit." The shrink fit technique comprises heating an outer part and cooling an inner part and positioning the inner part and the outer part relative to each other. The inner part and the outer part are allowed to come to a same temperature. Due to the lowering of temperature for the outer part and increase in temperature for the inner part, the outer part will shrink and the inner part will expand thereby securing them to each other. The coolant-slinging device will be described in greater detail with reference to FIG. 6.

Further, in accordance with aspects of the present technique, the one or more slingers 66 disposed on the proximal end 61 of the rotating shaft 60 may be surrounded by a hollow cavity, such as a drain annulus 64 in the housing 86. More particularly, the one or more drain annuli 64 may enclose each of the one or more slingers 66. The one or more slingers 66 rotate inside the drain annulus 64. The one or more drain annuli 64 may be employed in collecting any leaked liquid coolant. Moreover, each of the drain annulus 64 may be coupled to at least one primary coolant outlet 78. Additionally, the one or more drain annuli 64 may be shaped in a form so as to direct any leaked liquid coolant out of the rotating union 50 through one or more primary coolant outlets 78. In one embodiment, the one or more drain annuli 64 may be formed by machining a first part and a second part of the housing 86. The first part and the second part of the housing 86 may be joined together employing techniques such as, but not limited to, bolting, welding and brazing, to form a single piece in the shape of a drain annulus 64.

In accordance with further aspects of the present technique the rotating shaft 60 may further include a plurality of helical pumping grooves 68. The plurality of helical pumping grooves 68 may be disposed on the outer diameter of the rotating shaft 60 in one embodiment. More particularly, the plurality of helical pumping grooves 68 may be disposed on the outer diameter along the proximal end 61 of the rotating shaft 60. The plurality of helical pumping grooves 68 may be configured to direct the liquid coolant to the one or more drain annulus 64, thereby preventing leakage of the liquid coolant from the exemplary rotating union 50.

With continuing reference to FIG. 3, in one embodiment, the rotating shaft 60 may also include one or more secondary slingers 70. More particularly, the one or more secondary slingers 70 may be disposed along the outer diameter of the rotating shaft 60. Also, each of the one or more secondary slingers 70 may be coupled to at least one secondary coolant outlet 80 to direct the coolant that may have leaked past the one or more slingers 66 as well as the plurality of helical pumping grooves 68.

Additionally, it may be noted that the rotating shaft 60 in the exemplary rotating union 50 may rotate at high speeds. The high speed rotation may cause the rotating shaft 60 to deflect from its position thereby causing uneven wear between the rotating shaft 60 and the plurality of helical pumping grooves 68, for example. This uneven wear may result in shorter life of the rotating union 50. Hence, one or more bearings 74 may be employed on the housing 86 of the rotating union 50 to prevent deflection of the rotating shaft 60 which may be caused due to G-loads acting perpendicular to the rotating shaft 60.

Moreover, in one embodiment, the one or more bearings 74 may be disposed in a manner to prevent the rotating shaft 60 from making contact with the surroundings. More particularly, the one or more bearings 74 may prevent the rotating shaft 60 from making contact with the surroundings especially in the region where the plurality of helical pumping grooves 68 are disposed by providing a separation distance between the helical pumping grooves 68 and the housing 86. It may be noted that the separation between the helical pumping grooves 68 and the housing 86 may be in the order of about one thousandth of an inch.

Figure 4:
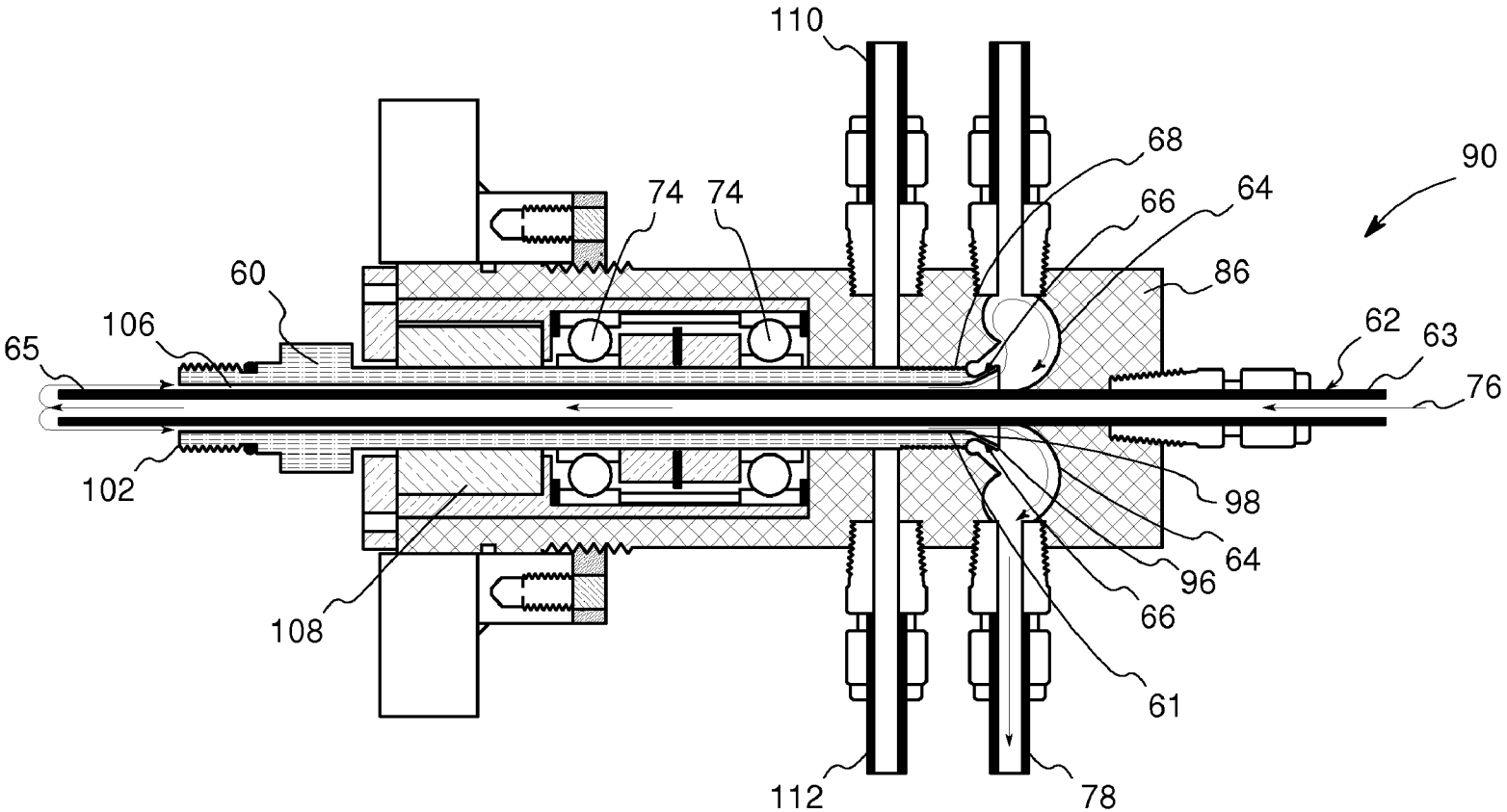
FIG. 4 is a cross-sectional view of another exemplary rotating union, in accordance with aspects of the present technique.

Turning now to FIG. 4, a cross sectional view of a rotating union 90 employing a circumferential seal 108, in accordance with aspects of the present technique, is presented. In one embodiment the circumferential seal 108 may comprise carbon such as, but not limited to graphite. In other embodiments, the circumferential seal may comprise materials, such as, but not limited to Teflon, Rulon, Nylon, brass, bronze and so forth. Here again, the stationary tube 62 having the first end 63 and the second end 65 is illustrated. A coolant flows into the stationary tube 62 from the first end 63. Reference numeral 76 is generally representative of the coolant flow from the first end 63 of the stationary tube 62. The coolant flow 76 is reversed when it reaches the second end 65 of the stationary tube 62. The coolant may then flow in an annular region 106 between the stationary tube 62 and the rotating hollow shaft 88 of FIG. 3. The rotating hollow shaft 88 of FIG. 3 may be coupled to a second end or a distal end 102 of the rotating shaft 60. The coolant enters the annular region 106 via the distal end 102 of the rotating shaft 60 and may be slung out to a plurality of drain annulus 64 via the one or more slingers 66. Thereafter, the coolant may be directed out of the rotating union 90 via a corresponding primary coolant outlet 78 as depicted. In one embodiment, at least one primary coolant outlet 78 may be coupled to each drain annulus 64 as depicted in FIG. 3.

As previously noted, each of the one or more slingers 66 may include a first end 98 and a second end 96. The first end 98 may have a diameter that is smaller than a diameter of the second end 96. Further, in one embodiment, the first end 98 of the one or more slingers 66 may be disposed on the proximal end 61 of the rotating shaft 60.

In another embodiment, the one or more slingers 66 may be machined from the proximal end 61 of the rotating shaft 60. Alternatively, the one or more slingers 66 may be bonded to the proximal end 61 of the rotating shaft. More particularly, the first end 98 of the one or more slingers 66 may be bonded to the proximal end 61 of the rotating shaft 60.

Further, a plurality of helical pumping grooves 68 may be disposed on the outer diameter of the rotating shaft 60. As described with reference to FIG. 3, the helical pumping grooves 68 may be disposed near the proximal end 61 of the rotating shaft 60, in one embodiment. More particularly, the helical pumping grooves 68 may be disposed adjacent to the one or more slingers 66 on the outer diameter of rotating shaft 60. The helical pumping grooves 68 may be configured to force the coolant to the drain annulus 64 thereby preventing the coolant to reach the bearings 74. This coolant may be directed out of the rotating union 90 via the primary coolant outlet 78. More particularly, an opposing pressure gradient may be established by the plurality of helical pumping grooves 68 on the outer diameter of the rotating shaft 60, thereby forcing the coolant to the drain annulus 64.

Additionally, the exemplary rotating union 90 may include one or more secondary coolant outlets 110, 112 configured to direct the coolant that may have leaked beyond the plurality of helical pumping grooves 68 out of the exemplary rotating union 90.

As previously noted, the circumferential seal 108 may, in accordance with aspects of the present technique, prevent the coolant from escaping or leaking out of the coolant flow arrangement according to the aspects of the present technique. Furthermore, as shown in the illustrated embodiment, the circumferential seal 108 may be disposed beyond bearings 74 towards the distal end 102 of the rotating shaft 60. Additionally, in certain other embodiments, the circumferential seal 108 may be disposed on the housing 86 of the rotating union 90. By implementing the circumferential seal 108 as described hereinabove any coolant that may leak beyond the helical pumping grooves 68 may be advantageously prevented.

Figure 5:
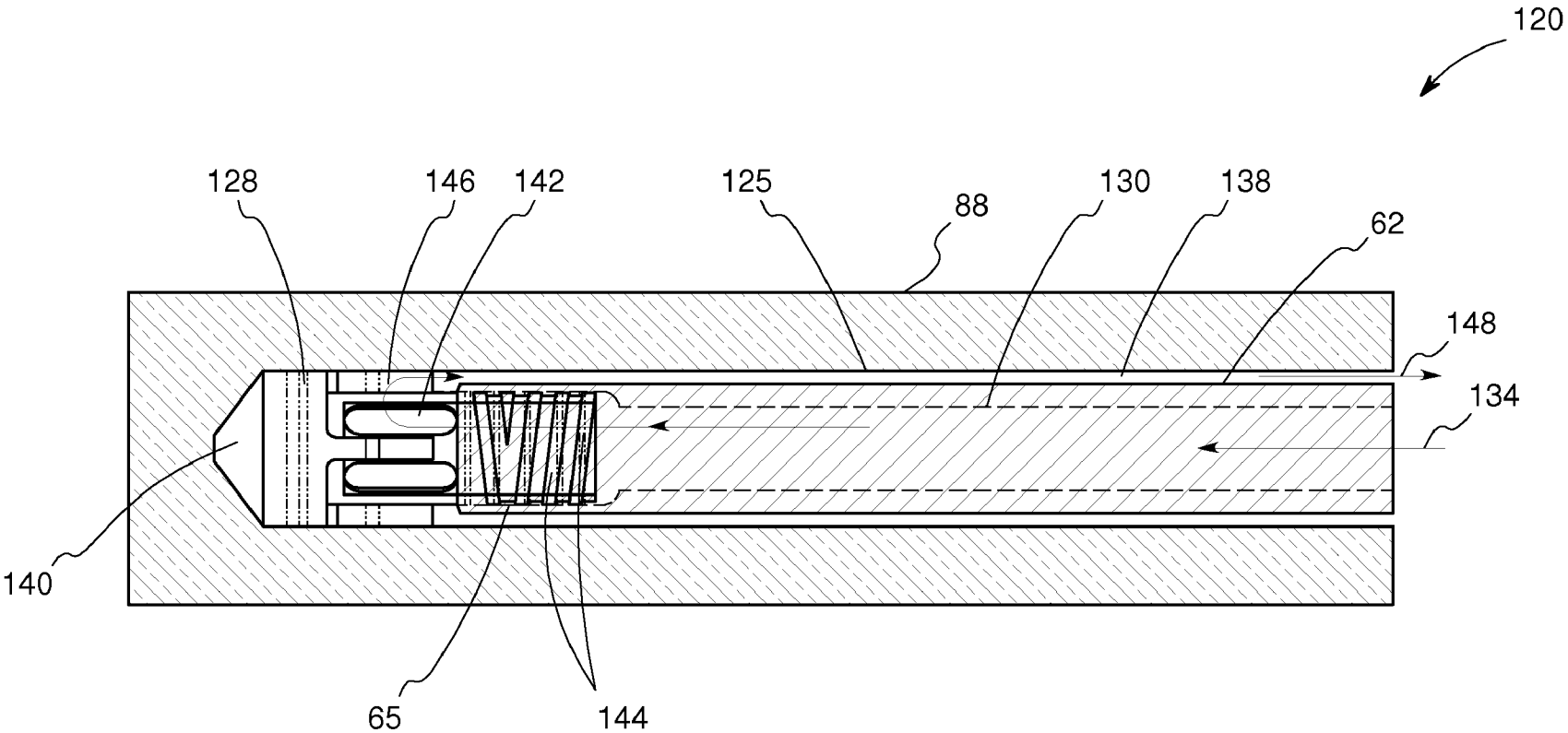
FIG. 5 is a blown up cross-sectional view of a stationary tube and its arrangement with a rotating hollow shaft of X-ray target, in accordance with aspects of the present technique.

Referring now to FIG. 5, a blown up cross-sectional view 120 of a stationary tube 62 and its arrangement with a rotating hollow shaft 88 of the X-ray target 58 (see FIG. 3) is depicted. The rotating hollow shaft 88 of the X-ray target may be coupled to the rotating shaft 60 of FIG. 3, of the rotating union 50 of FIG. 3. It may be noted that a second end 65 is a cantilevered end of the stationary tube 62 in an exemplary rotating union such as the rotating union 50 of FIG. 3 may be displaced from a central axis of rotation due to non-symmetric "G" forces that may be caused by rotation of the union when placed in a gantry and/or due to other machine vibration. In one embodiment, the rotating hollow shaft 88 may include a rotating piece 128 pressed into a rotating shaft bore 140. The rotating piece 128 may include a plurality of opposing grooves 144 in shape of a herringbone. The plurality of opposing grooves 144 may be disposed within the second end 65 of the stationary tube 62. Additionally, the opposing grooves 144 may be machined in the rotating piece 128 to create a centering force in one embodiment. In an alternate embodiment, the opposing grooves 144 may be formed on an inner diameter 130 of the stationary tube 62 in a manner such that the opposing grooves 144 extend radially across from a smooth surface on an outer diameter of the rotating piece 128. Alternatively, the opposing grooves 144 may be formed on the outer diameter of rotating piece 128 extending radially across from the smooth surface on the inner diameter 130 of the stationary tube 62. As the rotating hollow shaft 88 rotates, the rotating piece 128 spins inside the stationary tube 62. In accordance with aspects of the present technique, the opposing grooves 144 in the rotating piece 128 may create a naturally centering hydrodynamic force thereby ensuring proper concentric alignment of the stationary tube 62 even when the G force from rotation of the gantry act on the stationary tube 62. As illustrated in FIG. 5 reference numeral 134 may generally be representative of a coolant flow from a first end of the stationary tube 62 towards the second end 65 of the stationary tube 62. The rotating piece 128 may include one or more elongated slots 142 that may reverse coolant flow by directing the coolant to flow in an annular space 138 between the inner diameter 125 of the rotating hollow shaft 88 and the stationary tube 62 as depicted. More particularly, the elongated slots 142 may be shaped in a manner so as to reverse the direction of coolant flow by producing a pumping force. Reference numeral 146 may be representative of the reversed coolant flow. The coolant flowing in the annular space 138 between the stationary tube 62 and the inner diameter 125 of the rotating hollow shaft 88 may then be directed to the coolant-slinging device as indicated by reference number 148.

Figure 6:
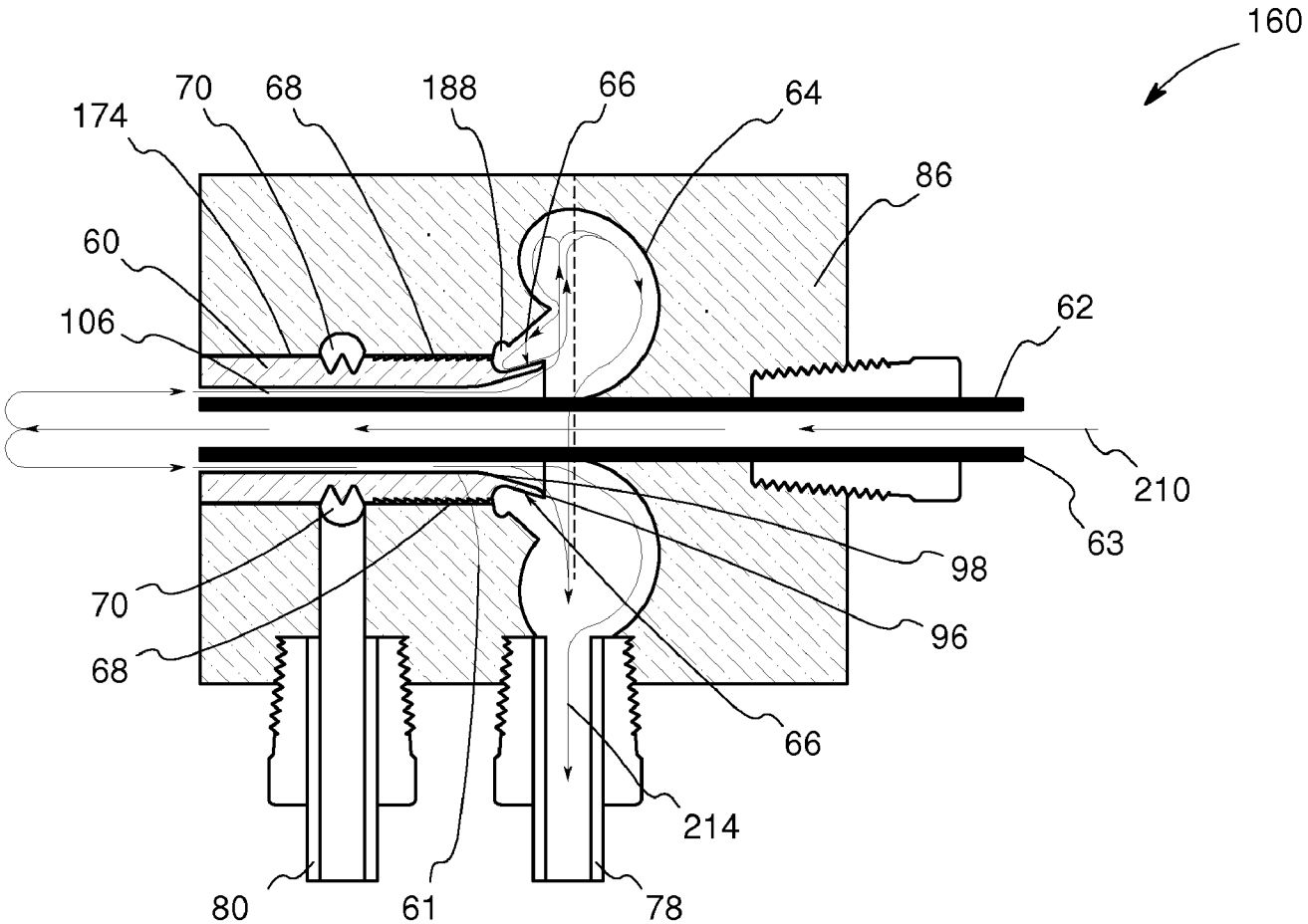
FIG. 6 is a cross-sectional view of an exemplary coolant-slinging device, in accordance with aspects of the present technique.

Referring now to FIG. 6, a blown up cross-sectional view of an exemplary coolant-slinging device 160 depicting coolant flow 210 is illustrated. As was described in FIG. 3, the coolant may be directed to flow from a first end 63 of a stationary tube 62 and may travel to an X-ray target such as the X-ray target 58 of FIG. 3. The flow direction 210 of the liquid coolant may be reversed in a manner as described with reference to FIG. 5. The coolant carries heat from the X-ray target and the Ferro-fluidic seals (not shown in FIG. 6) and flows along an annular space 106. A rotating shaft 60 includes a proximal end 61 and a distal end (not shown). The rotating shaft 60 has one or more slingers 66 disposed on the proximal end 61. The one or more slingers 66 include a first end 98 and a second end 96 where the first end 98 of the slinger 66 is disposed on the proximal end 61 of the rotating shaft 60. In accordance with aspects of the present technique, the coolant, upon exiting the annular space 106 at the proximal end 61 of the rotating shaft 60 may be slung outward from the first end of the slinger 66 towards a wall of one or more drain annulus 64. Additionally, some coolant may drop on the slinger 66 which may again be slung outward towards the wall of one or more drain annulus 64. In one embodiment, the drain annulus 64 may be shaped as depicted in FIG. 6 to direct the coolant out from an exemplary rotating union 90 (see FIG. 4) via a primary coolant outlet 78. Reference numeral 214 may be representative of a coolant flow out from the exemplary rotating union 90 (see FIG. 4).

Further, the coolant that may be accumulated in a clearance space 188 behind the one or more slingers 66 may be forced into the drain annulus 74 by the centrifugal force that may be generated by the rotating shaft 60. Furthermore, the coolant that may be accumulated in the clearance space 188 between the proximal end 61 of the rotating shaft 60 and a housing 86 of the rotating union may be forced by a plurality of helical pumping grooves 68 into the drain annulus 64 and subsequently through the primary coolant outlet 78. More particularly, an opposing pressure gradient may be established by the plurality of helical pumping grooves 68 on the outer diameter 174 of the rotating shaft 60 thereby forcing the coolant into the clearance space 188 and subsequently to the drain annulus 64. Additionally, the coolant may leak past the plurality of helical pumping grooves 68 due to wear. This problem of coolant leaking past the plurality of helical pumping grooves 68 may be circumvented via inclusion of a secondary slinger 70, in accordance with exemplary aspects of the present technique. In one embodiment, the secondary slinger 70 may be disposed on the outer diameter 174 of the rotating shaft 60. Further, the secondary slinger 70 may be configured to force the leaked coolant out through a secondary coolant outlet 80, thereby preventing coolant leakage. Accordingly, the exemplary coolant-slinging device 160 may prevent the coolant from traveling further down the rotating shaft 60 towards the bearings and a motor (not shown) and causing damage.

The rotating union for liquid cooled X-ray target as described hereinabove has several advantages such as prevention of leakage of a liquid coolant especially in a fast rotating CT gantry. The exemplary rotating union provides improved reliability, and enhanced durability and is suitable for operation at high G-loads.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A rotating union for an X-ray target, comprising:
a housing;
a coolant-slinging device disposed within the housing, comprising:
a rotating shaft having an inner diameter and an outer diameter, a proximal end and a distal end, and a bore therein;
one or more slingers coupled to a proximal end of the rotating shaft;
a drain annulus coupled to the one or more slingers, wherein the one or more slingers are configured to direct a coolant to the drain annulus and the drain annulus is configured to direct the coolant through a primary coolant outlet; and
a stationary tube having a first end and a second end, wherein at least a portion of the stationary tube is disposed within the bore of the rotating shaft.

2. The rotating union of claim 1, wherein the drain annulus is disposed within the housing.

3. The rotating union of claim 1, wherein the first end, the second end, or both the first end and the second end of the stationary tube protrude from the bore of the rotating shaft.

4. The rotating union of claim 1, further comprising a plurality of helical pumping grooves disposed on an outer diameter of the rotating shaft to direct the coolant to the drain annulus.

5. The rotating union of claim 1, wherein the primary coolant outlet is coupled to the drain annulus and configured to remove the coolant from the rotating union.

6. The rotating union of claim 1, further comprising one or more secondary slingers for directing a leaked coolant out of the rotating union through a secondary coolant outlet.

7. The rotating union of claim 1, further comprising one or more bearings disposed on the housing to prevent deflection of the rotating shaft.

8. The rotating union of claim 1, further comprising a circumferential seal disposed circumferentially along the outer diameter of the rotating shaft to prevent coolant leakage.

9. The rotating union of claim 1, wherein the one or more slingers comprise a first end and a second end, and wherein the first end of a slinger has a smaller diameter than the second end of the slinger for slinging the coolant into the drain annulus.

10. An X-ray source, comprising:
a rotating union comprising:
a housing;
a coolant-slinging device disposed within the housing, comprising:
a rotating shaft having an inner diameter and an outer diameter, a proximal end and a distal end, and a bore therein;
one or more slingers coupled to a proximal end of the rotating shaft;
a drain annulus coupled to the one or more slingers,
wherein the one or more slingers are configured to direct a coolant to the drain annulus, and wherein the drain annulus is configured to direct the coolant through a primary coolant outlet;
a stationary tube having a first end and a second end, wherein at least a portion of the stationary tube is disposed within the bore of the rotating shaft; and
a target operationally coupled to the distal end of the rotating shaft via a rotating hollow shaft.

11. The X-ray source of claim 10, wherein at least the first end, the second end, or both the first end and the second end of the stationary tube protrude from the bore of the rotating shaft.

12. A computed tomography system comprising:
an X-ray source for generating an X-ray beam, wherein the X-ray source comprises:
an X-ray target; and
a rotating union comprising:
a housing;
a coolant-slinging device disposed within the housing, comprising:
a rotating shaft having an inner diameter and an outer diameter, a proximal end and a distal end, and a bore therein;
one or more slingers coupled to a proximal end of the rotating shaft;
a drain annulus coupled to the one or more slingers,
wherein the one or more slingers are configured to direct a coolant to the drain annulus, and wherein the drain annulus is configured to direct the coolant through a primary coolant outlet;
a stationary tube having a first end and a second end, wherein at least a portion of the stationary tube is disposed within the bore of the rotating shaft;
an array of detector elements for detecting attenuated X-ray beam from an imaging object; and
a display for displaying an image of the imaging object.

13. The computed tomography system of claim 12, wherein the first end, the second end, or both the first end and the second end of the stationary tube protrude from the bore of the rotating shaft.

* * * * *